United States Patent [19]

Homan

[11] 4,186,833

[45] Feb. 5, 1980

[54] GIFT WRAPPING STORAGE CONTAINER

[76] Inventor: Virginia L. Homan, 11793 E. Jewell Pl., Aurora, Colo. 80012

[21] Appl. No.: 941,861

[22] Filed: Sep. 13, 1978

[51] Int. Cl.[2] ..... B65D 85/67

[52] U.S. Cl. ..... 206/225; 206/391

[58] Field of Search ..... 206/225, 227, 223, 215, 206/214, 394, 393, 391; 223/106, 107

[56] References Cited

U.S. PATENT DOCUMENTS

| | | | |
|---|---|---|---|
| 1,946,276 | 2/1934 | Castro-Barberena | 223/106 |
| 2,107,194 | 2/1938 | Yacker et al. | 206/214 |
| 2,565,893 | 8/1951 | Germain | 223/107 |
| 2,647,577 | 8/1953 | White | 206/391 |
| 3,145,646 | 8/1964 | Levy | 206/227 |
| 3,193,092 | 7/1965 | Parsons | 206/394 |

*Primary Examiner*—William T. Dixson, Jr.
*Attorney, Agent, or Firm*—Richard D. Law

[57] ABSTRACT

A hinged cover container having ribbon spool storage and dispensing dowels in the cover, and a divided major container portion for storage of folded paper in one section and cards and ribbons in a smaller section. The inside of the cover is provided with loops of elastic ribbon for securing hardware useful for wrapping.

2 Claims, 5 Drawing Figures

GIFT WRAPPING STORAGE CONTAINER

This invention relates to a storage container which is adapted for gift wrapping materials and hardware, maintaining gift wrapping material handy and available for use. The container has a hinged cover having ribbon storage facilities and hardware for the gift wrapping operations.

For most persons, wrapping gifts occurs frequently through the year, on birthdays, anniversaries, holidays, etc. It is indeed a tidy person who has gift wrapping material accumulated in one readily accessible point. But usually this location does not contain the hardware for wrapping e.g. scissors, bow making frames, pens for filling out cards, etc. So usually, considerable time and frustrations are consumed in wrapping gifts, particularly a few gifts for an occasion other then Christmas. To many persons, gift wrapping is a undesirable chore and so they must use the gift wrapping facilities of a store.

According to the invention, there is provided a storage container for gift wrapping materials and hardware for the wrapping, providing a single location for the entire gift wrapping. The container has a hinged cover with a high dome, into which are a plurality of dowels for containing reels of ribbons, and string and an elastic band secured to a side of the cover and formed into a plurality of loops for temporarily securing hardware, etc. and a carrier for self sticking tape. The container is divided into at least two compartments, one for folded paper and one for cards, bows, stickers and the like. The container includes a lock set for securing the unit when it is not in use. A handle permits easy handling of the unit.

OBJECTS OF THE INVENTION

Included among the objects of the invention is to provide a handy storage container for gift wrapping materials.

Another object of the invention is to provide a storage container for gift wrapping which is compartmentalized to maintain different items separately.

Still another object of the invention is to provide a closable storage container for gift wrapping materials which is easily transportable, and takes up little space for storage.

Yet another object of the invention is to provide a readily usable storage container maintaining all items used for gift wrapping in one place.

These and other objects and advantages of the invention may be readily ascertained by reference to the following description and appended illustrations.

GENERAL DESCRIPTION OF THE DRAWINGS

SPECIFIC DESCRIPTION OF THE DRAWINGS

In general, the device of the invention is a preferred form, is a lightweight container for gift wrappings mail wrappings for packages, etc. which is arranged with specific storage spaces for particular items, and arranged to maintain the various items separated. The unit has a hinged cover and a releasable lock for storage of the contents of the container.

Figure 1:
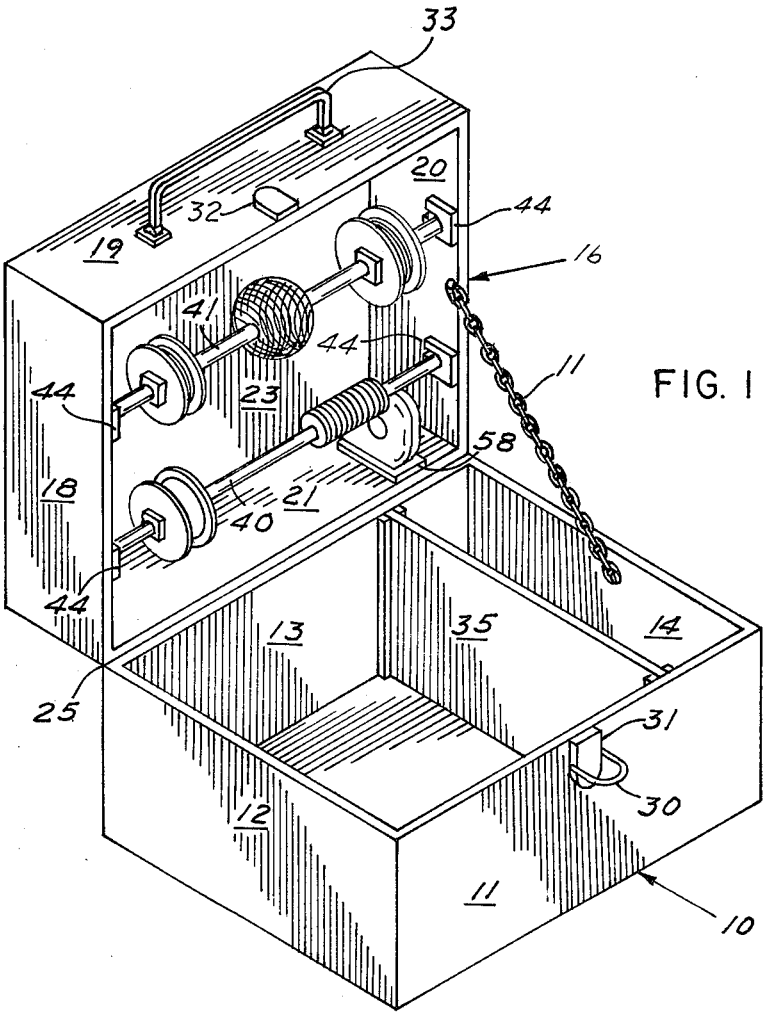
FIG. 1 is a perspective view of one form of the invention showing the container in open condition, exposng the contents.
Figure 2:
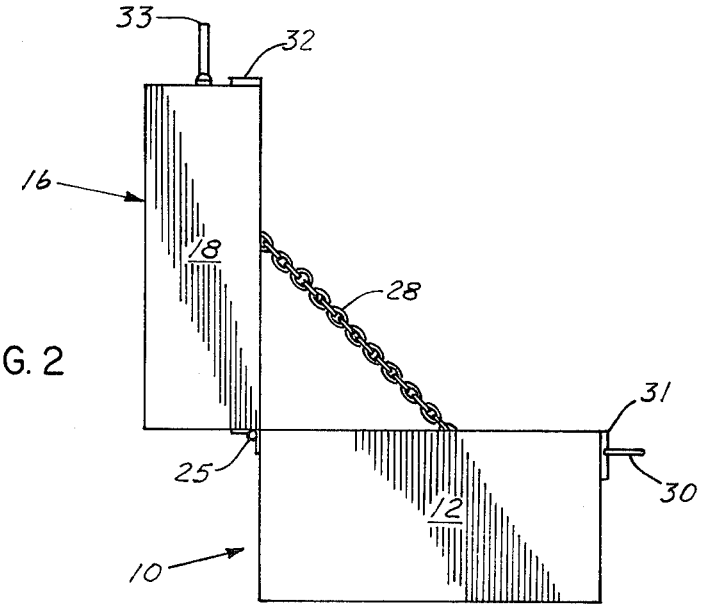
FIG. 2 is a side elevational view of the device of FIG. 1.

As shown in FIG. 1, the container includes a bottom portion, shown generally by numeral 10, which is an open top box having sides 11, 12, 13 and 14, and a bottom closure 15. A cover, shown generally by numeral 16, includes sides 18, 19, 20 and 21 and a top panel 23. The cover is hingedly secured to the bottom by means of a hinge 25 secured to the top side member 21 and bottom side member 13. A piano type hinge is a preferred hinge, but other types may be satisfactory. For example, if the unit is formed of a synthetic plastic, the hinge may also be plastic, or if the unit is made of wood several small hinges may be used to control the amount of travel of the top opening. A closure means provides for holding the parts together for travel or storage. One usable fastener is a bail and stud fastener. As shown, a bail 30 pivotally attached to mount 31 is arranged to snap over stud 32 on the cover. A fold-down handle 33 provides a convenient method of handling the closed case.

The bottom section of the unit has a dividing wall 35, in one instance, supported by upright moldings forming a groove on each side wall 11 and 13. This provides a small space in the side of the bottom section, and a pocket 37 with an elastic top 38 may be provided on the wall 35. This pocket may hold cards or the like, useful for identification of wrapped packages, mailing tags, greeting tags, etc. The small compartment may be used to store prepared ribbons and bows and the like. This space may be about 3" wide.

The cover member is arranged to hold spools for ribbons, balls of string, reels of tape or the like. For the unit shown, a pair of rods 40 and 41 fit in brackets 44 on each side wall of the cover. The brackets may be conventional, arranged to secure the rods therein, but permits removal of the rods for adding or removing spools, rolls, etc. Small size containers for example, about 12" by 15" (rectangular) easily support 2 rods. Other sizes of containers may use other numbers of rods. The sides of the cover must, of course, be deep enough to accomodate ths size of spool or reels to be placed on the rods. The total depth of the container may be 7½ to 9 inches, approximately ½ is for the cover and the other half is for the bottom.

Figure 3:
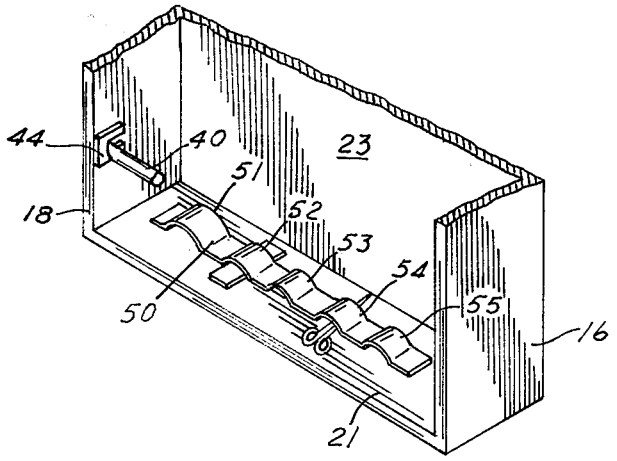
FIG. 3 is an enlarged detail view of a portion of the cover adjacent the cover hinge, showing additional storage spaces.
Figure 4:
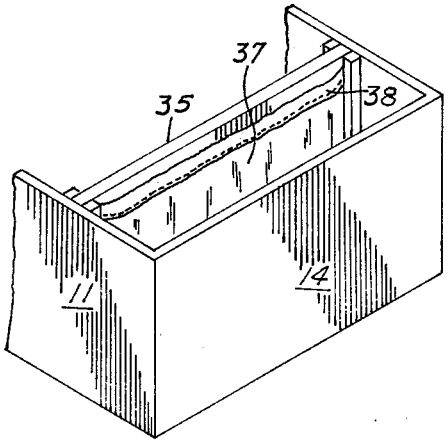
FIG. 4 is an enlarged detail view of a section of the container showing still additional storage spaces for cards, etc.
Figure 5:
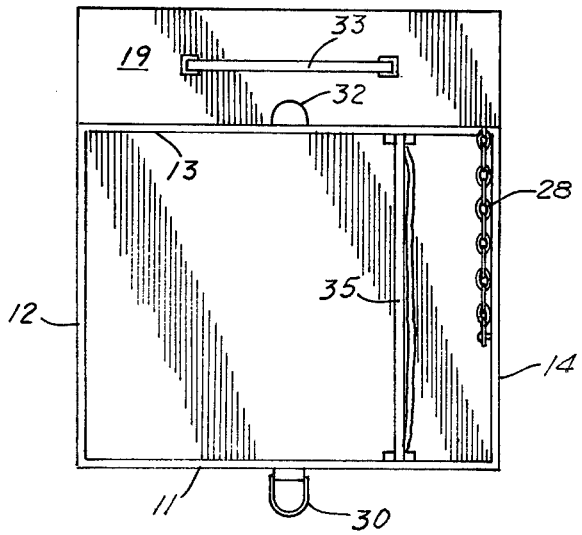
FIG. 5 is a top plan view of the open container of FIG. 1.

The cover wall 21 may, also, include additional storage for small items, by using an elastic band 50, FIG. 3, secured at the ends and in a number of intermediate areas, leaving loops 51, 52, 53, 54 and 55. Cards, as under loop 52 or scissors under loop 54 may be removably stored in the cover for easy retrieval, but securely held for travel or storage.

A container 58 may be provided for supporting a roll of non-drying self adhesive tape in position for pulling of a length without removal of the roll. This may include a tape cutter, all in the manner of desk-type self sealing adhesive tape dispenser.

The main compartment of the container bottom may be used for folded wrapping paper, bows, etc. The unit is thus compact, and capable of holding a sufficient quantity of wrapping material, and holding the material with little scattering or disturbing during carrying the closed container. It effectively holds all the materials normally needed to wrap packages, for gifts, mailing or the like.

While the invention has been described by reference to a particular embodiment, there is no intent to limit the spirit or scope of the invention, except as defined in the following claims.

What is claimed is:

1. In an assembled storage container for gift wrapping materials having an open top box section and a hinged domed top, the improvement of:

(a) at least about two rods spaced apart and releasably mounted from side wall to wall in the top for holding reels of ribbons in position for retrieving portions of the ribbon;

(b) elastic tape means in the hinge side of the domed top including a plurality of loops for securing small items in retrievable storage position;

(c) the bottom section being divided into at least two sections, the first section being large and arranged as a folded paper storage compartment and the second being small, and said sections being divided by wall means; and (d) pocket means having a closing biased elastic top on said wall means in said small section arranged to hold cards and stickers.

2. The improvement of claim 1, being further characterized by a holder for a roll of non-drying self sticking adhesive tape mounted on the hinge side of said domed top, supporting the same in dispensing arrangement and with a tape cutter.

* * * * *